US007925033B2

(12) United States Patent
Okazawa

(10) Patent No.: US 7,925,033 B2
(45) Date of Patent: Apr. 12, 2011

(54) ELECTRO-ACOUSTIC TRANSDUCER

(76) Inventor: Hiroshi Okazawa, Tokyo (JP)

( * ) Notice: Subject to any disclaimer, the term of this patent is extended or adjusted under 35 U.S.C. 154(b) by 1174 days.

(21) Appl. No.: 11/603,985

(22) Filed: Nov. 24, 2006

(65) Prior Publication Data

US 2007/0116305 A1 May 24, 2007

(30) Foreign Application Priority Data

Nov. 24, 2005 (JP) ..... 2005-338330

(51) Int. Cl.
*H04R 25/00* (2006.01)
*H04R 3/00* (2006.01)
*H04R 19/00* (2006.01)
*B06B 1/06* (2006.01)

(52) U.S. Cl. ..... 381/191; 381/113; 381/116; 381/174; 367/170; 367/181

(58) Field of Classification Search ..... 381/191, 381/174; 310/334
See application file for complete search history.

(56) References Cited

U.S. PATENT DOCUMENTS 6,201,874 B1 * 3/2001 Croft et al. ..... 381/191
2002/0135272 A1 * 9/2002 Toda ..... 310/334

FOREIGN PATENT DOCUMENTS

JP A 56-165490 12/1981

* cited by examiner

*Primary Examiner* — Brian Ensey
*Assistant Examiner* — Sunita Joshi
(74) *Attorney, Agent, or Firm* — Oliff & Berridge, PLC

(57) ABSTRACT

The present invention provides a stable and excellent electro-acoustic transducer having simple constitution with which a vibration pole does not contact with stator poles by a repulsive force acting between the vibration pole and the stator poles and the vibration pole can be stably positioned in place between the two stator poles. A vibration pole is disposed between two stator poles, and surfaces of the vibration pole and the two stator poles facing to each other have electrostatically same polarity to generate an electrostatic repulsive force as a restorative force acting between the vibration pole and the stator poles, so that the vibration pole is positioned in place and electro-acoustic conversion is performed by the vibration displacement of the vibration pole with respect to the stator poles. Whereby, the vibration pole does not contact substantially with the stator poles and the vibration pole is stably positioned in place.

1 Claim, 2 Drawing Sheets

(PRIOR ART)

ELECTRO-ACOUSTIC TRANSDUCER

BACKGROUND OF THE INVENTION

1. Field of the Invention

The present invention relates to an electro-acoustic transducer such as a speaker and a microphone.

2. Description of the Related Art

As a known example of an electro-acoustic transducer similar to a constitution of the present invention in which one vibration part is disposed between two stator parts, there is one in which an attractive force owing to an electrostatic force acts between the vibration part and the stator parts to perform electro-acoustic conversion operation by the change of the attractive force and the vibration change of the vibration part in response to the change of the attractive force.

For example, in an electrostatic electro-acoustic transducer shown in a frame format of FIG. 3, a film-shaped vibration pole 10 capable of performing vibration displacement is disposed in parallel between two stator poles 20 disposed in parallel with each other. The vibration pole 10 is charged to one polarity (plus in shown example) and the stator poles 20 are charged to the other polarity (minus in shown example) to generate an electrostatic attractive force between the vibration pole 10 and the stator poles 20. The potential of the stator pole 20 is changed by an acoustic signal unit 30 connected to the stator pole 20 to generate change of the attractive force and drive the vibration pole 10, thereby generating acoustic wave. If the vibration pole 10 is vibrationally displaced by the generated acoustic wave or acoustic wave from outside, electric charge moves or acoustic signal current flows between the vibration pole 10 and the stator pole 20 by electrostatic induction and by way of detection thereof the electro-acoustic conversion is performed. This constitution is disclosed in Japanese Unexamined Patent Application Publication No. 56-165490.

However, in the above-described related art that is operated by causing an electrostatic attractive force between the vibration pole and the stator pole, since the intensity of an attractive force acting between the vibration pole and the stator pole is increased with inversely proportional to square of a distance between the vibration pole and the stator pole, there may be a serious problem that the vibration pole contacts with the stator pole. In order to cope with the problem, the constitution of the electro-acoustic transducer becomes complicate, and amplitude is limited. Moreover, deformation and noise are generated.

Since an attractive force acts between the vibration pole and the stator pole, in order to position the vibration pole in place with respect to the stator pole, it is necessary to mechanically fix and maintain the vibration pole in a state that the vibration pole is tensioned by an elastic restorative force. Accordingly, the structure becomes complicate and the selection of material is limited for obtaining proper elasticity.

Since the vibration pole must vibrationally displace in a state that the vibration pole is mechanically fixed and maintained, the operation of vibration displacement becomes elastic deformation displacement and deterioration with age may easily caused by elastic fatigue.

Moreover, it is not known that a vibration part is disposed between two stator parts and a repulsive force is caused between the stator part and the vibration part by a magnetic force to perform operation for electro-acoustic conversion by the change of the repulsive force by magnetic force and the vibration change of the vibration part in response to the change of the repulsive force.

SUMMARY OF THE INVENTION

The present invention is contrived to solve problems in the related art, and an object is to provide a stable and excellent electro-acoustic transducer having simple constitution with which a vibration pole does not contact with stator poles by a repulsive force acting between the vibration pole and the stator poles and the vibration pole can be stably positioned in place between the two stator poles.

An electro-acoustic transducer according to an aspect of the invention includes two stator poles having sound transmitting property and disposed in parallel with each other, and a membranous vibrating pole capable of performing vibration displacement and disposed in parallel between the two stator poles, wherein surfaces of the vibration pole and the two stator poles facing to each other have electrostatically same polarity to generate an electrostatic repulsive force as a restorative force between the vibration pole and the stator poles, so that the vibration pole is positioned in place between the two stator poles and electro-acoustic conversion is performed by the vibration displacement of the vibration pole with respect to the stator poles.

In the above aspect of the invention, since the vibration pole is disposed in parallel between the two stator poles disposed in parallel with each other and surfaces of the vibration pole and the stator poles facing to each other have electrostatically same polarity, an electrostatic repulsive force is generated between the vibration pole and the stator pole and the vibration pole is positioned in place where electrostatic repulsive forces from the two stator pole become equal by way of the electrostatic repulsive force as a restorative force.

Namely, the vibration pole positioned between the two stator poles is positioned in place by way of the electrostatic repulsive force acting between the vibration pole and the stator pole as a restorative force without mechanical means.

As such, since the vibration pole is positioned in place between the two stator poles by way of the electrostatic repulsive force acting between the vibration pole and the stator pole, if the vibration pole approaches the stator pole, the electrostatic repulsive force acting between the vibration pole and the stator pole increases rapidly with inversely proportional to square of the decreased distance between the vibration pole and the stator pole.

If an acoustic signal is applied to the stator pole as change of an electrostatic force, the vibration pole is driven by change of a repulsive force with respect to the stator pole to generate acoustic wave. If the vibration pole performs relative vibration displacement with respect to the stator pole by the acoustic wave, an electrostatic repulsive force acting between one stator pole and the vibration pole and an electrostatic repulsive force acting between the other stator pole and the vibration pole are increased or decreased in opposite directions to generate change of an electrostatic repulsive force. This change is detected as an electrical acoustic signal by electrostatic induction.

As described in the above, since the vibration pole is positioned between the two stator poles and the vibration displacement of the vibration pole is performed in response to only electrostatic repulsive forces acting between the vibration pole and the stator poles, the vibration pole does not need elasticity at all and moreover elasticity of the vibration pole does not affect the vibration displacement operation of the vibration pole.

The invention having the above-described constitution exhibits following advantages.

In an aspect of the invention, since the vibration pole is positioned in place between the two stator poles by way of the electrostatic repulsive force acting between the vibration pole and the stator pole, if the vibration pole approaches the stator pole, the electrostatic repulsive force acting between the vibration pole and the stator pole increases rapidly with inversely proportional to square of the decreased distance between the vibration pole and the stator pole. Therefore, the vibration pole cannot contact with the stator pole by overcoming the increased electrostatic repulsive force and thereby the generation of accident that the vibration pole contact with the stator pole can be prevented completely.

Furthermore, since the vibration pole and the stator poles have electrostatically same polarity, even when they contact with each other, serious problems such as discharge and adsorption are generated little.

Moreover, since the vibration pole positioned between the two stator poles is positioned in place by way of the electrostatic repulsive force acting between the vibration pole and the stator pole as a restorative force without mechanical means, it is not necessary to provide a structure exclusively for positioning the vibration pole in place and hence a structure of an electro-acoustic transducer is easily simplified.

In addition, since the vibration displacement of the vibration pole is performed in response to only electrostatic repulsive forces acting between the vibration pole and the stator poles, the vibration pole does not need elasticity at all. Therefore, the vibration pole does not influenced from deterioration with age caused by elastic fatigue and can operate stably for a long time.

BRIEF DESCRIPTION OF THE DRAWINGS

The invention will be described with reference to the accompanying drawings, wherein like numbers reference like elements.

DESCRIPTION OF THE PREFERRED EMBODIMENTS

Preferred embodiments of the invention are described in detail hereafter with reference to the accompanying drawings.

Figure 1:
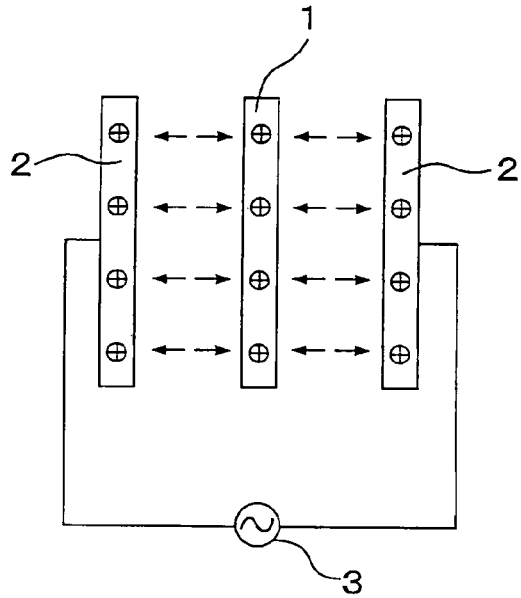
FIG. 1 is a view showing an electrical frame format of an embodiment of the invention.

FIG. 1 shows an electrical frame format of an embodiment of an electro-acoustic transducer of the invention. By charging a vibration pole 1 and a pair of stator poles 2 to same polarity (plus in shown example) in a state that the vibration pole 1 is disposed between the pair of stator poles 2 disposed in parallel with each other, electrostatic repulsive forces are generated between the vibration pole 1 and the stator poles 2, so that the vibration pole 1 is positioned in place at a middle position between the two stator poles 2 by the electrostatic repulsive force as a restorative force.

In this state, if an acoustic signal that is an alternate current signal is applied between the two stator poles 2 from an acoustic signal unit 3 in case of a speaker, potentials of the two stator poles 2 are changed in response to the application of the acoustic signal such that the potential of one stator pole is increased and the potential of the other stator pole is decreased. Therefore, the vibration pole 1 is vibrationally displaced by change of electrostatic repulsive force between the vibration pole 1 and each stator pole 2 in response to potential change of the two stator poles 2 to generate acoustic wave.

In case of a microphone, if the vibration pole 1 is vibrationally displaced by the action of acoustic wave, electrostatic repulsive forces between the vibration pole 1 and both stator poles 2 are changed such that one increases and the other decreases. Therefore, charges flow in a direction that equalizes the electrostatic repulsive forces between the two stator poles 2, and hence an acoustic signal is generated.

Figure 2:
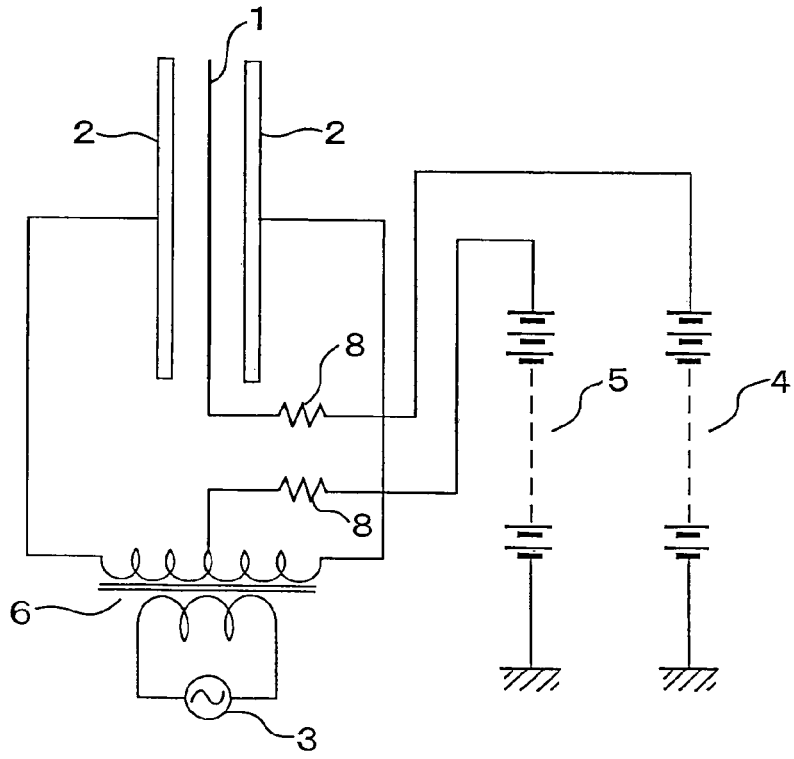
FIG. 2 is a schematic circuit diagram of an embodiment shown in FIG. 1.
Figure 3:
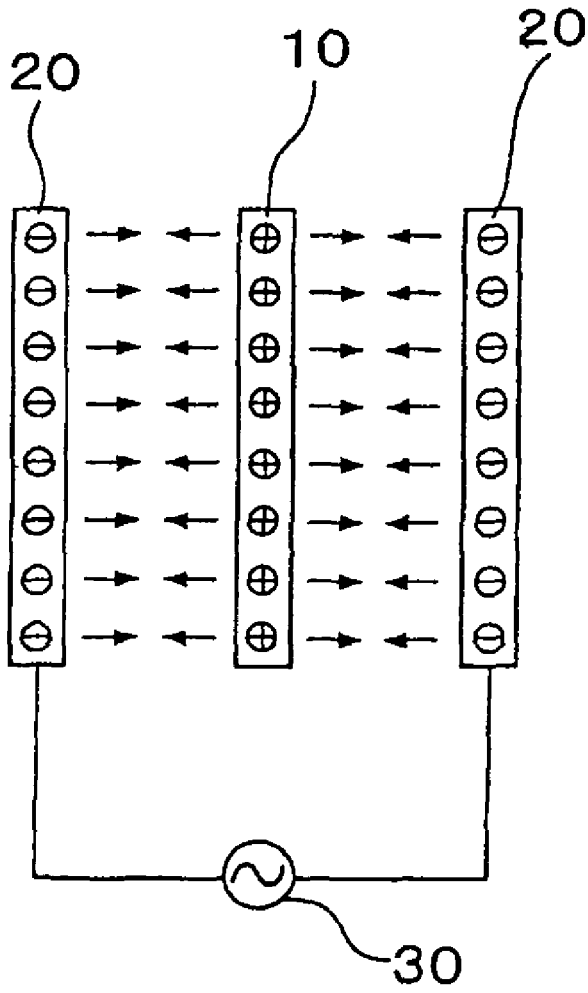
FIG. 3 is a view showing an electrical frame format for illustrating the related art.

FIG. 2 is a schematic circuit diagram of an electrostatic electro-acoustic transducer according to the present invention. The film-shaped vibration pole 1 is disposed in parallel between two plate-shaped stator poles 2 oppositely disposed in parallel with each other. The vibration pole 1 is applied with one potential (plus potential in shown example) from a direct current high-voltage source 4 that is a bias supply via a regulating resistor 8. Similarly, a middle tap of secondary winding of a transformer 6 connected between the two stator poles 2 is applied with one potential (plus potential in shown example) from a direct current high-voltage source 5 that is a bias supply via a regulating resistor 8 and a primary winding of the transformer 6 is connected to the acoustic signal unit 3.

Suitable material for the vibration pole 1 is synthetic resin material or fiber material such as paper, etc., which can be easily formed into film shape capable of performing vibration displacement and is processed to have weak conductive property.

The stator pole 2 is formed from conductive material into plate shape that is not deformable and has gaps for sound transmitting property.

Since the vibration pole 1 and the two stator poles 2 are applied with bias voltage of same polarity from the direct current high-voltage source 4 and the direct current high-voltage source 5 to become a state charged to same polarity (plus in shown example) together. Therefore, the vibration pole 1 is positioned in place where the electrostatic repulsive forces are equalized by the electrostatic repulsive forces acting between the vibration pole 1 and the two stator poles 2 as a restorative force.

In case of operating as a speaker, if an acoustic signal that is an alternate current signal is applied from the acoustic signal unit 3, an voltage change signal is generated to the secondary winding of the transformer 6 in response to the acoustic signal to change potentials of the two stator poles 2 to be increased or decreased in directions opposite to each other.

Therefore, the vibration pole 1 is displaced in a direction that equalizes the electrostatic repulsive forces acting between the vibration pole 1 and the two stator poles 2 in response to change of the electrostatic repulsive force between the vibration pole 1 and the two stator poles 2 by change of potentials, and the displacement becomes vibration to generate acoustic wave.

In case of operating as a microphone, if the vibration pole 1 is vibrationally displaced by the acted acoustic wave, electrostatic repulsive forces between the vibration pole 1 and the two stator poles 2 are changed in directions opposite to each other to be increased or decreased in response to change of distances between the vibration pole 1 and the stator pole 2.

Therefore, in response to increase or decrease of electrostatic repulsive forces between the vibration pole 1 and the two stator poles 2, charge flows between the two stator poles 2 in a direction that cancels the increase or decrease of electrostatic repulsive forces and hence current is generated. The current is detected as an acoustic signal by the acoustic signal unit 3 via the transformer 6.

In the electrostatic electro-acoustic transducer shown in FIGS. 1 and 2, by constituting the vibration pole 1 with electret, cumbersome imparting of charge to the vibration pole 1 can be omitted and hence it is possible to simplify the constitution.

Similarly, in the electrostatic electro-acoustic transducer shown in FIGS. 1 and 2, by constituting the vibration pole 1 with electret and incorporating electret into the stator pole 2 to generate desired electrostatic repulsive force between the vibration pole 1 and the stator pole 2, the direct current high-voltage source 4 and the direct current high-voltage source 5 for applying bias voltage are not needed at all, and hence the entire constitution can be remarkably simplified.

What is claimed is:

1. An electro-acoustic transducer comprising:

two stator poles having sound transmitting property and disposed in parallel with each other; and a membranous vibrating pole capable of performing vibration displacement and disposed in parallel between the two stator poles;

wherein surfaces of the vibration pole and the two stator poles facing to each other have electrostatically same polarity to generate an electrostatic repulsive force as a restorative force between the vibration pole and the stator poles, so that the vibration pole is positioned in place between the two stator poles and electro-acoustic conversion is performed by the vibration displacement of the vibration pole with respect to the stator poles.

* * * * *